US010408075B2

(12) United States Patent
Bunker

(10) Patent No.: US 10,408,075 B2
(45) Date of Patent: Sep. 10, 2019

(54) TURBINE ENGINE WITH A RIM SEAL BETWEEN THE ROTOR AND STATOR

(71) Applicant: General Electric Company, Schenectady, NY (US)

(72) Inventor: Ronald Scott Bunker, Placitas, NM (US)

(73) Assignee: General Electric Company, Schenectady, NY (US)

( * ) Notice: Subject to any disclaimer, the term of this patent is extended or adjusted under 35 U.S.C. 154(b) by 397 days.

(21) Appl. No.: 15/238,233

(22) Filed: Aug. 16, 2016

(65) Prior Publication Data

US 2018/0051580 A1 Feb. 22, 2018

(51) Int. Cl.

*F01D 11/04* (2006.01)
*F01D 11/00* (2006.01)
*F01D 25/12* (2006.01)

(52) U.S. Cl.

CPC ..... *F01D 11/04* (2013.01); *F01D 11/001* (2013.01); *F01D 25/12* (2013.01); *F05D 2220/32* (2013.01); *F05D 2240/55* (2013.01); *F05D 2240/80* (2013.01); *F05D 2260/20* (2013.01); *F05D 2300/514* (2013.01); *F05D 2300/612* (2013.01)

(58) Field of Classification Search

CPC ..... F01D 11/001; F01D 11/04; F01D 25/12; F05D 2220/32; F05D 2240/55; F05D 2240/80; F05D 2260/20; F05D 2300/514
USPC ..... 415/173.5, 173.7, 174.5
See application file for complete search history.

(56) References Cited

U.S. PATENT DOCUMENTS

| | | | | |
|---|---|---|---|---|
| 3,339,933 | A * | 9/1967 | Phillips Foster | F16J 15/44 277/415 |
| 5,211,536 | A * | 5/1993 | Ackerman | F01D 9/042 415/177 |
| 5,358,374 | A * | 10/1994 | Correia | F01D 5/081 415/115 |
| 6,916,021 | B2 * | 7/2005 | Beeck | F01D 5/225 277/411 |
| 6,960,060 | B2 * | 11/2005 | Lee | F01D 5/081 415/115 |
| 7,435,049 | B2 * | 10/2008 | Ghasripoor | F01D 5/225 277/415 |
| 7,967,559 | B2 | 6/2011 | Bunker | |
| 8,016,552 | B2 | 9/2011 | Bunker | |
| 2003/0062256 | A1 * | 4/2003 | Gueldry | F01D 11/001 204/192.12 |
| 2007/0224035 | A1 | 9/2007 | Nigmatulin | |

(Continued)

FOREIGN PATENT DOCUMENTS

| | | | |
|---|---|---|---|
| CN | 101858230 | A | 10/2010 |
| EP | 2239422 | A2 | 10/2010 |

OTHER PUBLICATIONS

Chinese Office Action corresponding to Chinese Application No. 201710702715.5 dated Feb. 28, 2019.

*Primary Examiner* — Igor Kershteyn
(74) *Attorney, Agent, or Firm* — McGarry Bair PC

(57) ABSTRACT

An apparatus relating to a rim seal for turbine engine comprising a wing and discourager extending into a cavity to form a labyrinth fluid path. The wing and discourager can each include a radial extension. Cooling air can pass through the rim seal along the labyrinth fluid path to resist the ingestion of hot gas from a mainstream flow.

28 Claims, 6 Drawing Sheets

(56) References Cited

U.S. PATENT DOCUMENTS

| | | | | |
|---|---|---|---|---|
| 2008/0145208 | A1* | 6/2008 | Klasing | F01D 5/082<br>415/173.7 |
| 2013/0017095 | A1* | 1/2013 | Lee | F01D 5/081<br>416/239 |
| 2017/0298736 | A1* | 10/2017 | Spadacini | F01D 5/041 |

* cited by examiner

TURBINE ENGINE WITH A RIM SEAL BETWEEN THE ROTOR AND STATOR

BACKGROUND OF THE INVENTION

Turbine engines, and particularly gas or combustion turbine engines, are rotary engines that extract energy from a flow of combusted gases passing through a fan with a plurality of blades, then into the engine through a series of compressor stages, which include pairs of rotating blades and stationary vanes, through a combustor, and then through a series of turbine stages, also consisting of rotating blades and stationary vanes.

In operation, turbine engines operate at increasingly hotter temperatures as the gasses flow from the compressor stages to the turbine stages. Various cooling circuits for the components exhaust to the main flowpath and must be provided with cooling air at sufficient pressure to prevent ingestion of the hot gases therein during operation.

For example, seals are provided between the stationary turbine nozzles and the rotating turbine blades to prevent ingestion or backflow of the hot gases into the cooling circuits. Improving the ability of these seals to prevent ingestion or backflow increases engine performance and efficiency.

BRIEF DESCRIPTION OF THE INVENTION

In one aspect, embodiments relate a turbine engine comprising a rotor having at least one disk with circumferentially spaced blades, a stator having at least one ring with circumferentially spaced vanes, with the rings being adjacent the disk, a rim seal comprising a wing extending from the disk, a discourager extending from the ring, with a labyrinth fluid path formed between the wing and the discourager, wherein at least a portion of one of the wing and the discourager is formed from a porous material.

In another aspect, embodiments relate a rim seal between a rotor and a stator of a turbine engine comprising a wing extending from the rotor, a discourager extending from the stator, and a labyrinth fluid path formed between the wing and the discourager, wherein at least a portion of one of the wing and the discourager is formed from a porous material.

In yet another aspect, embodiments relate a rim seal for turbine engine comprising a wing extending from a rotor and a discourager extending from a stator with at least a portion of one of the wing and discourager formed from a porous material.

DESCRIPTION OF EMBODIMENTS OF THE INVENTION

Figure 1:
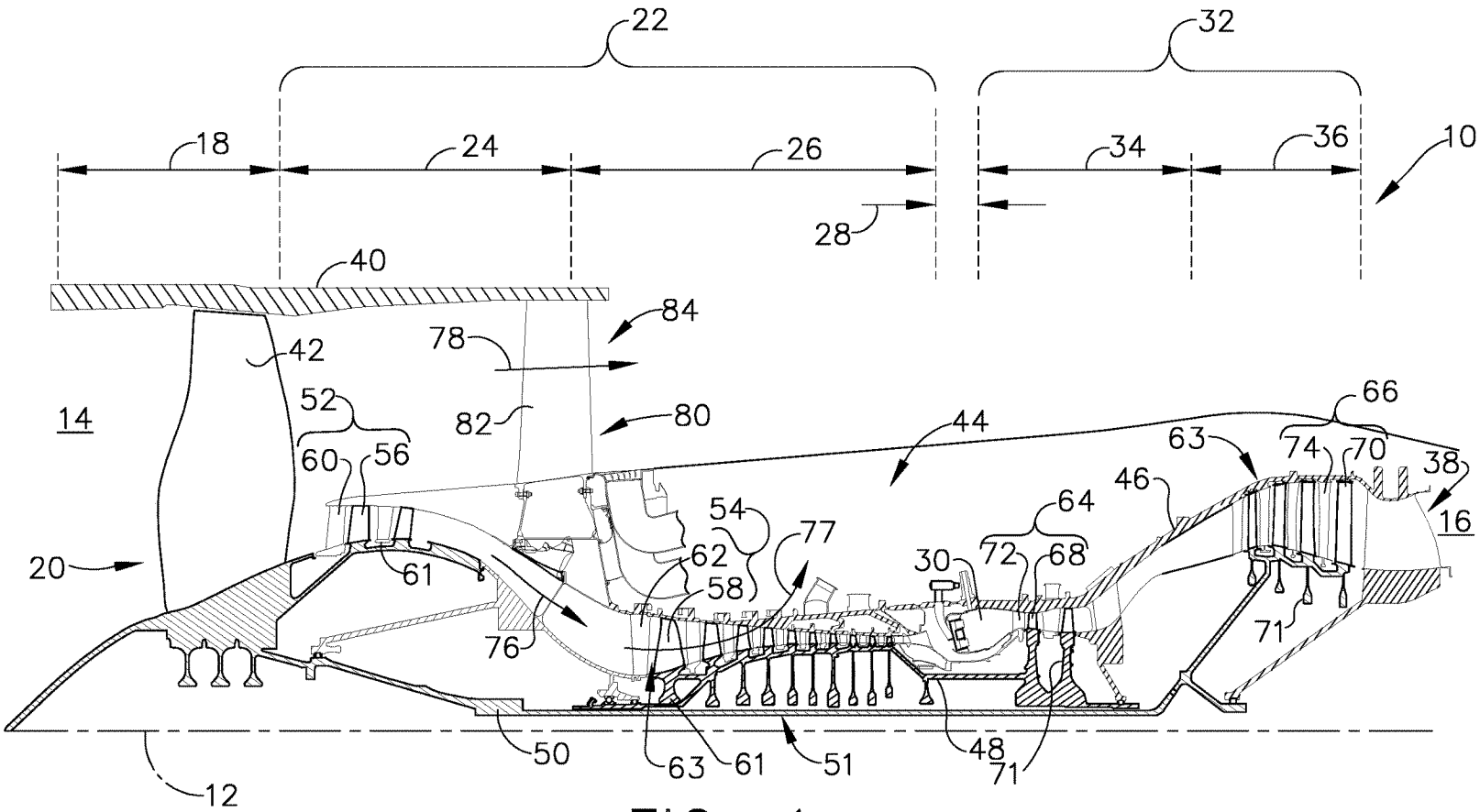
FIG. 1 is a schematic cross-sectional diagram of a turbine engine for an aircraft.

The described embodiments of the present invention are directed to a rim seal between a rotor and stator in a turbine section of a turbine engine where a portion of one or both of a wing and discourager is formed from a porous material. For purposes of illustration, the present invention will be described with respect to the turbine for an aircraft gas turbine engine. It will be understood, however, that the invention is not so limited and may have general applicability to engine sections beyond the turbine and to non-aircraft applications, such as other mobile applications and non-mobile industrial, commercial, and residential applications.

As used herein, the term "forward" or "upstream" refers to moving in a direction toward the engine inlet, or a component being relatively closer to the engine inlet as compared to another component. The term "aft" or "downstream" used in conjunction with "forward" or "upstream" refers to a direction toward the rear or outlet of the engine or being relatively closer to the engine outlet as compared to another component.

Additionally, as used herein, the terms "radial" or "radially" refer to a dimension extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present invention, and do not create limitations, particularly as to the position, orientation, or use of the invention. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 is a schematic cross-sectional diagram of a turbine engine 10 for an aircraft. The engine 10 has a generally longitudinally extending axis or centerline 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the centerline 12. The HP compressor 26, the combustor 30, and the HP turbine 34 form a core 44 of the engine 10, which generates combustion gases. The core 44 is surrounded by core casing 46, which can be coupled with the fan casing 40.

A HP shaft or spool 48 disposed coaxially about the centerline 12 of the engine 10 drivingly connects the HP turbine 34 to the HP compressor 26. A LP shaft or spool 50, which is disposed coaxially about the centerline 12 of the engine 10 within the larger diameter annular HP spool 48, drivingly connects the LP turbine 36 to the LP compressor 24 and fan 20. The spools 48, 50 are rotatable about the engine centerline and couple to a plurality of rotatable elements, which can collectively define a rotor 51.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 can be provided in a ring and can extend radially outwardly relative to the centerline 12, from a blade platform to a blade tip, while the corresponding static compressor vanes 60, 62 are positioned upstream of and adjacent to the rotating blades 56, 58. It is noted that the number of blades, vanes, and compressor stages shown in FIG. 1 were selected for illustrative purposes only, and that other numbers are possible.

The blades 56, 58 for a stage of the compressor can be mounted to a disk 61, which is mounted to the corresponding one of the HP and LP spools 48, 50, with each stage having its own disk 61. The vanes 60, 62 for a stage of the compressor can be mounted to the core casing 46 in a circumferential arrangement.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 can be provided in a ring and can extend radially outwardly relative to the centerline 12, from a blade platform to a blade tip, while the corresponding static turbine vanes 72, 74 are positioned upstream of and adjacent to the rotating blades 68, 70. It is noted that the number of blades, vanes, and turbine stages shown in FIG. 1 were selected for illustrative purposes only, and that other numbers are possible.

The blades 68, 70 for a stage of the turbine can be mounted to a disk 71, which is mounted to the corresponding one of the HP and LP spools 48, 50, with each stage having a dedicated disk 71. The vanes 72, 74 for a stage of the compressor can be mounted to the core casing 46 in a circumferential arrangement.

Complementary to the rotor portion, the stationary portions of the engine 10, such as the static vanes 60, 62, 72, 74 among the compressor and turbine section 22, 32 are also referred to individually or collectively as a stator 63. As such, the stator 63 can refer to the combination of non-rotating elements throughout the engine 10.

In operation, the airflow exiting the fan section 18 is split such that a portion of the airflow is channeled into the LP compressor 24, which then supplies pressurized air 76 to the HP compressor 26, which further pressurizes the air. The pressurized air 76 from the HP compressor 26 is mixed with fuel in the combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

A portion of the pressurized airflow 76 can be drawn from the compressor section 22 as bleed air 77. The bleed air 77 can be draw from the pressurized airflow 76 and provided to engine components requiring cooling. The temperature of pressurized airflow 76 entering the combustor 30 is significantly increased. As such, cooling provided by the bleed air 77 is necessary for operating of such engine components in the heightened temperature environments.

A remaining portion of the airflow 78 bypasses the LP compressor 24 and engine core 44 and exits the engine assembly 10 through a stationary vane row, and more particularly an outlet guide vane assembly 80, comprising a plurality of airfoil guide vanes 82, at the fan exhaust side 84. More specifically, a circumferential row of radially extending airfoil guide vanes 82 are utilized adjacent the fan section 18 to exert some directional control of the airflow 78.

Some of the air supplied by the fan 20 can bypass the engine core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid can be, but are not limited to, fluid discharged from the LP compressor 24 or the HP compressor 26.

Figure 2:
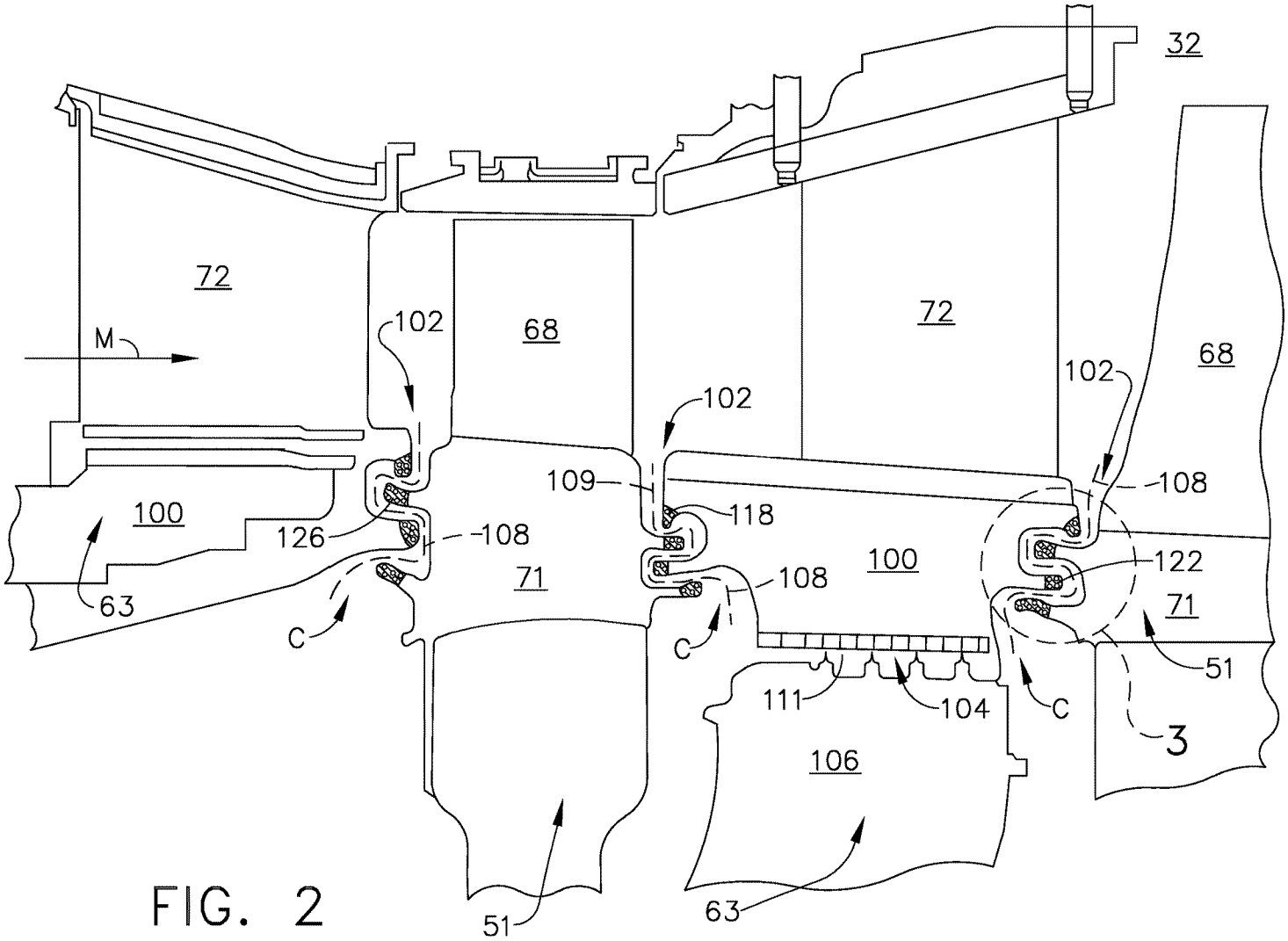
FIG. 2 is a sectional view of a turbine section of the turbine engine of FIG. 1.

FIG. 2 depicts a portion of the turbine section 32 including the stator 63 and the rotor 51. While the description herein is written with respect to a turbine, it should be appreciated that the concepts disclosed herein can have equal application to a compressor section, as well as any other part of the turbine engine that uses a rim seal between rotating and stationary parts. The rotor 51 includes at least one disk 71 with circumferentially spaced blades 68. The rotor 51 can rotate about the centerline 12, such that the blades 68 rotate radially around the centerline 12.

The stator 63 includes at least one ring 100 with circumferentially spaced vanes 72. The ring 100 is adjacent the disk 71 and form a rim seal 102 between the rotor 51 and stator 63. A radial seal 104 can mount to a stator disk 106 adjacent to the ring 100. Each vane 72 is radially spaced apart from each other to at least partially define a path for a mainstream airflow M.

The mainstream airflow M moves in a forward 14 to aft 16 direction, driven in part by the blades 68. Together the HP and LP turbines 34, 36 also contribute to drive the HP and LP compressors 24, 26 to achieve the overall pressure ratio needed to drive the core flow. The rim seal 102 and radial seal 104 can have leak paths 109, 111 through which some airflow from the mainstream airflow M can leak in a direction opposite of the mainstream airflow M causing unwanted heating of portions of the rotor 51 and stator 63. A labyrinth fluid path 108 extends between the ring 100 and the disk 71 and is used to prevent ingestion of the airflow M by retarding unwanted heating from areas of the engine 10 that are being cooled. Such ingested hot air could be avoided by supplying greater amounts of cooling air C, decreasing efficiency. Improving the seal 102 and path 108 such that as little as possible amount of coolant C is required to retard the unwanted heating is discussed herein.

Figure 3:
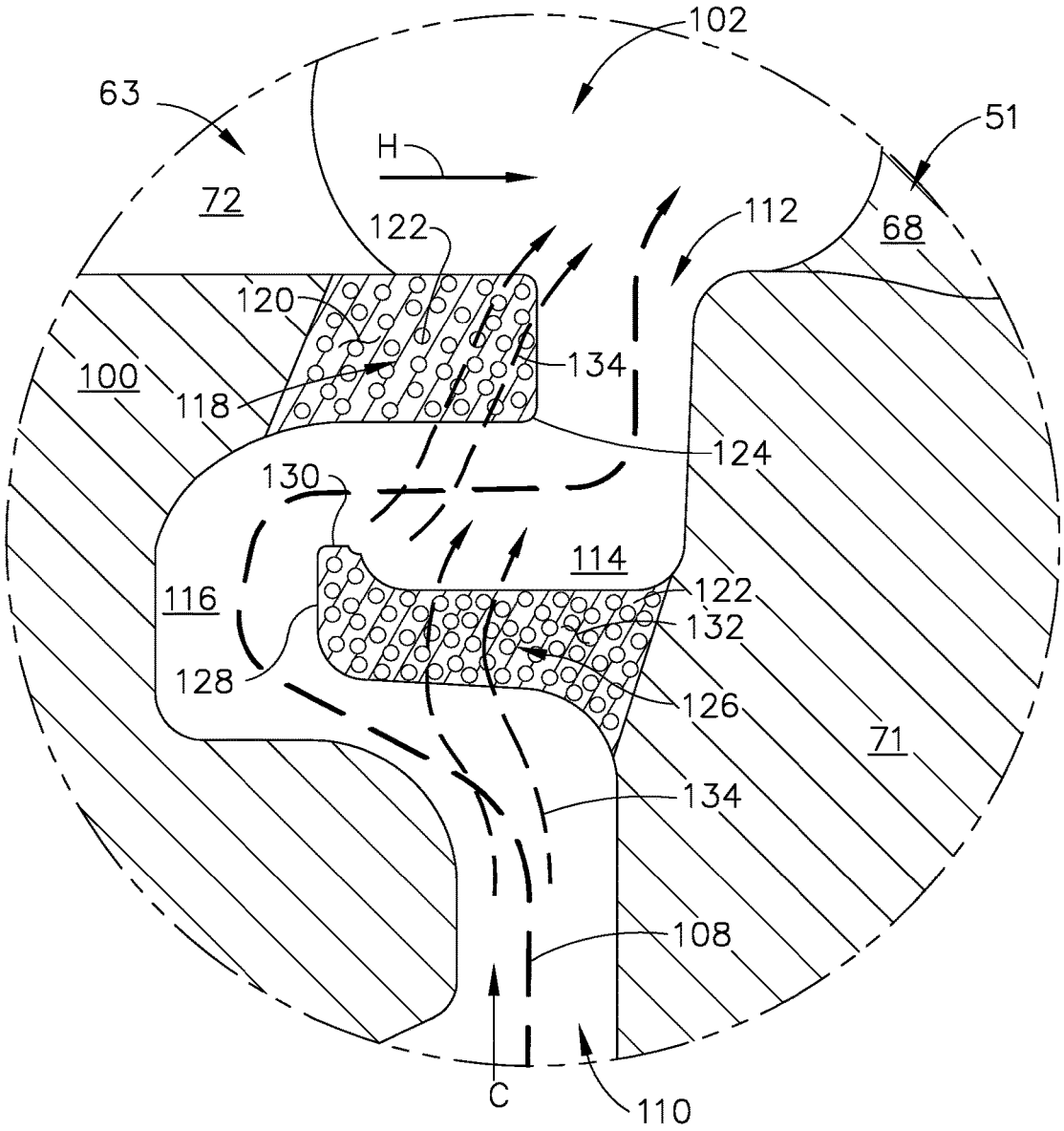
FIG. 3 is an enlarged view of a section of FIG. 2 illustrating a rim seal.

Turning to FIG. 3 an enlarged view of a portion 3 of FIG. 2 more clearly details the rim seal 102. The rim seal 102 includes an inlet 110 and an outlet 112 between the ring 100 and disk 71. The inlet 110 and outlet 112 have an axial spacing greater than axial tolerances between the disk 71 and ring 100 to prevent rubbing and deterioration of parts during operation.

The rim seal 102 comprises at least first and second cavities 114, 116 where a discourager 118 extends from the ring 100 into the first cavity 114. The extent to which the discourager 118 extends is determined by the axial tolerances between the disk 71 and ring 100. The discourager 118 can have a portion 120 at least partially formed from a porous material 122. This portion 120 can include the entire discourager 118. A terminal end 124 of the discourager 118 can define part of the outlet 112 and be of either a radial or axial orientation.

The porous material 122 can be of random porosity or structured porosity or a combination of both. Material with random porosity can be placed as a filler and includes air voids and pockets that vary in size and shape. Material with a structured porosity can be placed using additive manufacturing so that the air voids and pockets within have predetermined shape, sizes, and orientation depending on the requirements and limitations of the rim seal 102. The forming and placing of the porous material is not limited to fillers and additive manufacturing and other techniques of manufacturing can be contemplated.

A wing 126 extends from the disk 71 into the second cavity 116 wherein the wing 126 and discourager 118 at least partially overlap in an axial direction and are spaced in a radial direction. The wing 126 can have a terminal end 128 defining part of the labyrinth path 108. The terminal end 124 can include a radial extension 130 protruding radially towards the discourager 118. The radial spacing between the radial extension 130 and discourager 118 is greater than radial tolerances between the wing 126 and the discourager 118. Like the discourager 118, the wing 126 can have a portion 132 formed from the porous material 122 wherein that portion 132 can be the entire wing 126.

While the wing 126 is illustrated as having a radial extension 130, the radial extension 130 can be located on one of the wing 126 or discourager 118, both the wing 126 and discourager 118, or neither the wing 126 or discourager 118. It should be understood that the rim seal 102 can have a plurality of cavities and is not meant to be limited to two cavities 114 and 116 as illustrated.

The extension of both the discourager 118 and wing 126 form the labyrinth fluid path 108 where cooling air C entering the inlet 110 can turn in a serpentine motion around the wing 126 and discourager 118 exiting at the outlet 112. Additionally, a portion of the cooling air 134 can travel through the porous material 122 to cool the ring 100 and disk 71. As the portion of cooling air 134 travels through the porous material, the portion of cooling air 134 becomes relatively hotter than the cooling air C and remains relatively cooler than the hot airflow H.

Figure 4:
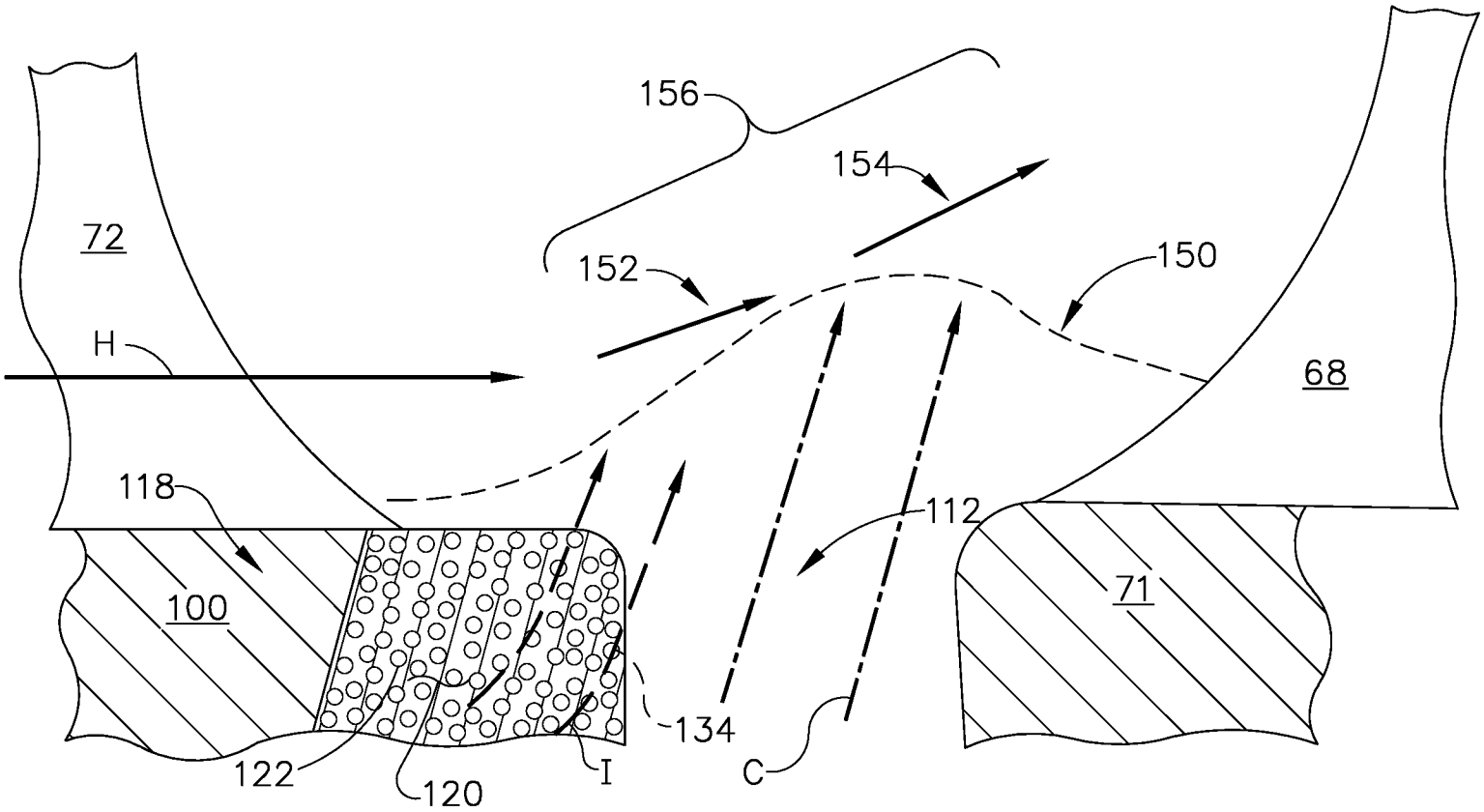
FIG. 4 is an illustration of a flow profile at an outlet of the rim seal of FIG. 3.

Turning to FIG. 4, the portion of cooling air 134 is illustrated as an intermediate flow I, having a temperature with a value somewhere between the hot airflow H and cooling air C as it exits the outlet 112. The intermediate flow I and cooling air C exit the outlet 112 together forming a momentum profile 150 in which the hot airflow H is first deflected radially outward 152 by the intermediate flow I and then further deflected radially outward 154 by the cooling air C in a serial deflection 156. The serial deflection 156 causes the hot airflow H to turn gradually resulting in a less turbulent intersection of airflows H, I, C as compared to when only cooling air C exits the outlet 112. It should be understood that the momentum profile 150 represents momentum vectors comprising both velocity and amount of air and representing the resulting turbulence from the mixing of the airflows H, I, and C.

The physical characteristics of porous material 122 can be selected to control the shape of the momentum profile 150. For example, the thickness of the porous material can be constant or variable to alter the momentum profile 150. The extent to which the porous material comprises the wing or discourage can be selected to control the momentum profile 150. The porosity can also be controlled. The porosity can also be constant or varying, especially in the structured porous material. The passages forming the porosity in the porous material can also be controlled to control where and in what direction the air is emitted from the porous material.

While the momentum profile 150 is shown as a bell-shaped profile, other profile shapes are contemplated. A more angular profile can be made, including a wedge. An airfoil profile is contemplated. The profile can be continuous or discontinuous. The profile can also be rectilinear or curvilinear.

Figure 5:
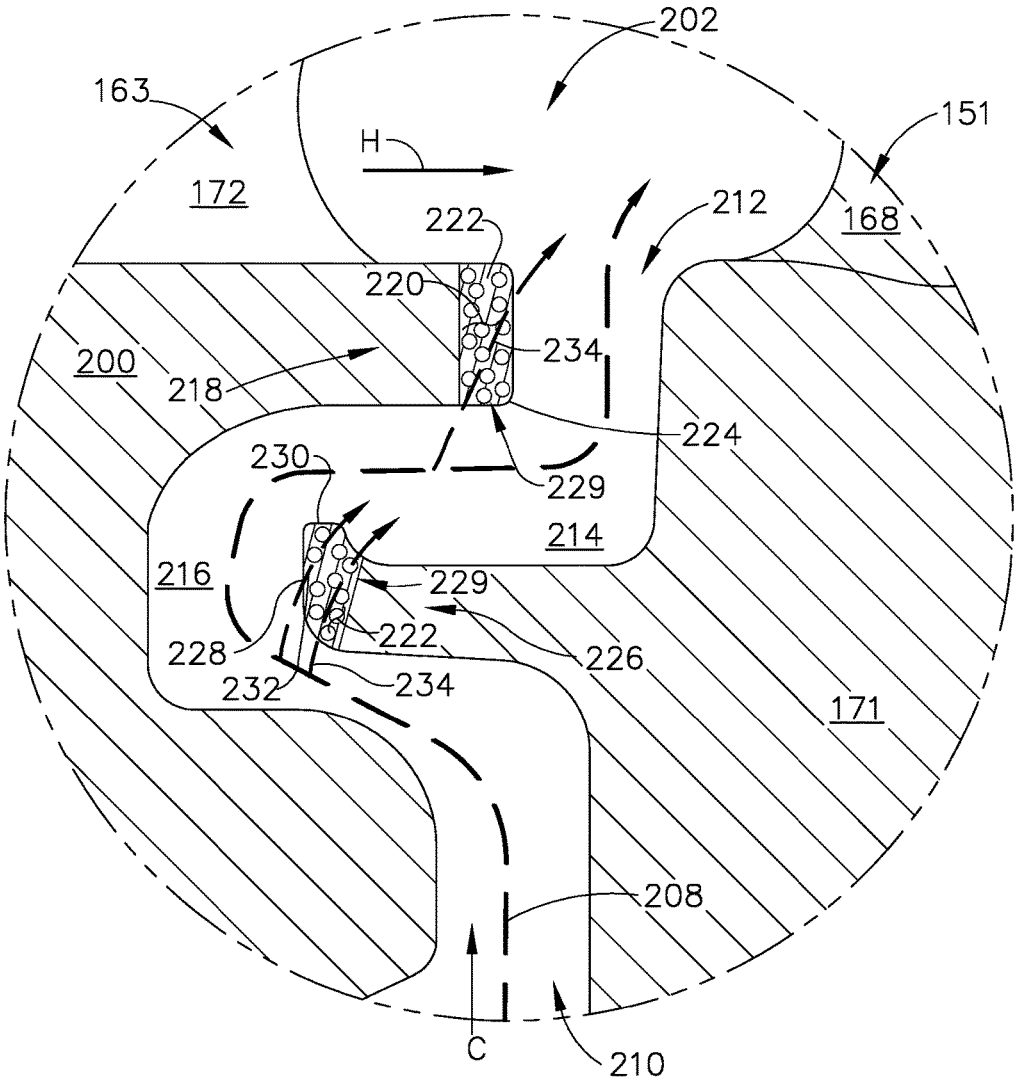
FIG. 5 is a second embodiment of the rim seal of FIG. 3.

Additional embodiments of rim seal 102 are contemplated in FIGS. 4 and 5 which are similar to the first embodiment and therefore like parts will be identified with like numerals increased by 100, with it being understood that the description of the like parts of the first embodiment applies to the additional embodiments unless otherwise noted. It should be understood that FIGS. 4 and 5 are illustrations of different contemplations regarding the rim seal 102 and that actual placement, location, and orientation of the porous material 122 is not limited to these embodiments.

In FIG. 5 a discourager 218 is spaced radially from a wing 226 where porous material 222 defines a tip 229 of the wing 226 and the discourager 218. The tip 229 can be any portion 232 of the terminal end 228, for example a radial extension 230 as illustrated on the wing 226 or an entire portion 220 of a terminal end 224 as illustrated on the discourager 218.

Figure 6:
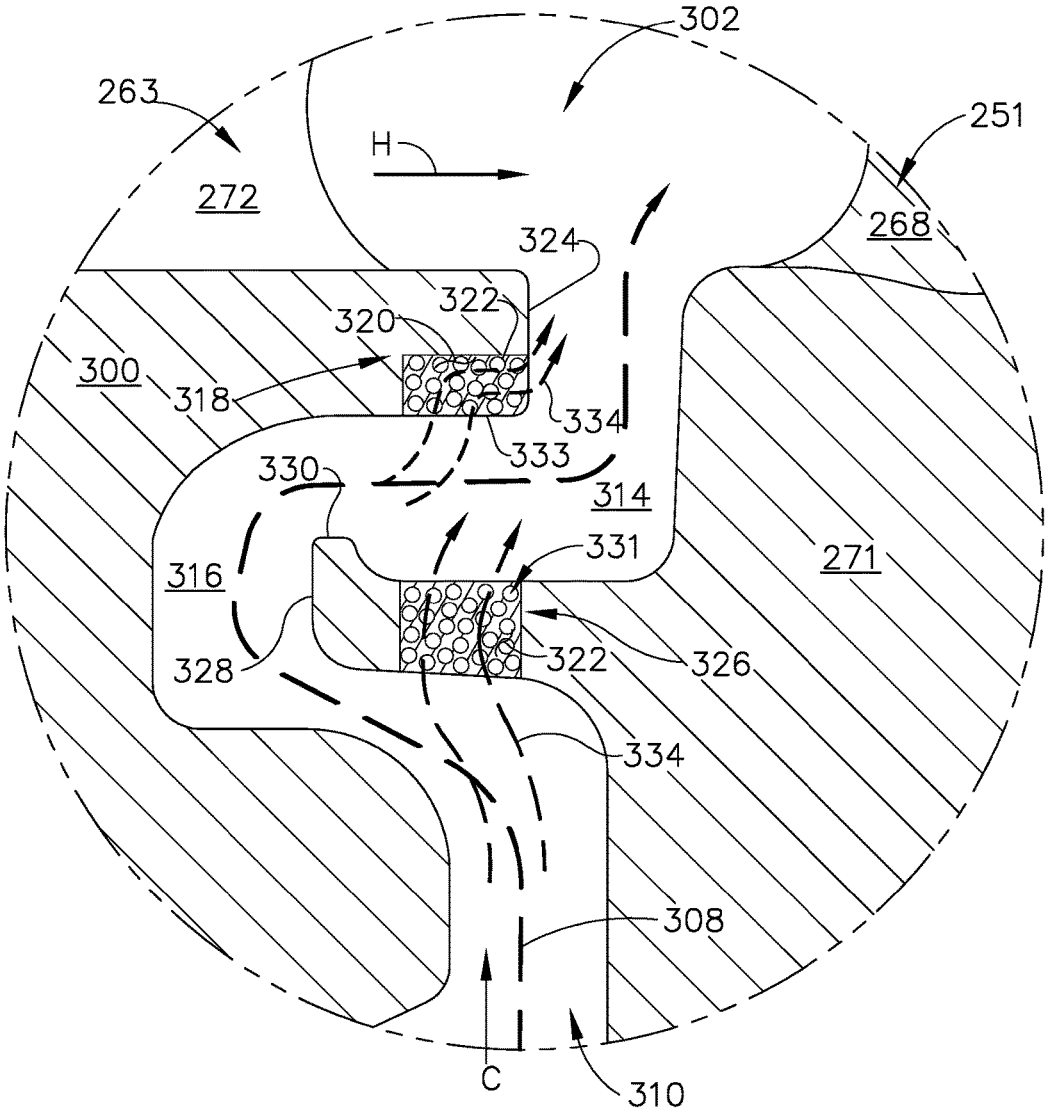
FIG. 6 is a third embodiment of the rim of FIG. 3.

In a third embodiment illustrated in FIG. 6, a discourager 318 is spaced radially from a wing 326 where porous material 322 is located on a middle section 331 of the wing 326. The middle section 331 is any portion of the wing between the terminal end 328 and the disk 271. A layer of porous material 322 defines an inner surface 333 of the discourager 318 radially across from the middle section 331 of the wing 326. The layer 333 can define a portion 320 of a terminal end 324 of the discourager 318.

It should be understood that any combination of the examples disclosed herein can also be contemplated and that FIG.s are shared for illustrative purposes only and not meant to be limiting. The placement and location of the porous material 122 is dependent on the location of the rim seal 102 and operating conditions, temperature, pressures, operating time etc., associated with the location of the rim seal 102.

It can be further contemplated that while the FIG.s described herein imply that porous regions are continuous, these regions can also be segmented to be placed with respect to vane and blade locations in which the porous regions occur. A circumferential pressure profile in the mainstream airflow above the rim seal location can also influence placement and location of the porous regions.

Benefits of including porous material 122 in at least one location of the rim seal 102 includes resisting hot gas H ingestion from the mainstream flow M. The serial deflection 156 of the hot airflow H occurs due to the momentum profile 150 formed from the intermediate flow I and cooling air C preventing the ingestion of hot airflow H into the rim seal 102. The location of the porous material portions 120, 132 can be optimized to create the most beneficial momentum profile 150 from the intermediate flow I and cooling air C to enable the highest efficiency for the mainstream airflow M.

The configurations described herein prevent hot gas from ingesting past the cavities where it can be detrimental to portions of the rotor and stator. Preventing hot gas from ingesting also allows for less purge flow and therefore improved specific fuel consumption (SFC).

It should be appreciated that application of the disclosed design is not limited to turbine engines with fan and booster sections, but is applicable to turbojets and turbo engines as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine engine comprising:

a rotor having at least one disk with circumferentially spaced blades;

a stator having at least one ring with circumferentially spaced vanes, with the rings being adjacent the disk;

a rim seal comprising a wing extending from the disk, a discourager extending from the ring, with a labyrinth fluid path formed between the wing and the discourager;

wherein at least a portion of one of the wing and the discourager is formed from a porous material.

2. The turbine engine of claim 1 wherein the porous material has at least one of a structured porosity or random porosity.

3. The turbine engine of claim 1 wherein the porous material is in a portion of both the wing and the discourager.

4. The turbine engine of claim 1 wherein the porous material is located in a middle section of one of the wing or discourager.

5. The turbine engine of claim 1 wherein the porous material is located in a terminal end of one of the wing or discourager.

6. The turbine engine of claim 1 wherein the entire wing or discourager is porous material.

7. The turbine engine of claim 1 wherein the wing and discourager at least partially overlap in an axial direction and are spaced in a radial direction.

8. The turbine engine of claim 7 wherein the radial spacing is greater than the radial tolerances between the wing and the discourager and the axial spacing is greater than the axial tolerances between the disk and the ring.

9. The turbine engine of claim 1 wherein the porous material is located in a radial extension.

10. The turbine engine of claim 9 wherein the radial extension extends into a cavity.

11. The turbine engine of claim 10 wherein the radial extent is less than radial tolerances between the disk and the ring.

12. The turbine engine of claim 1 wherein the porous material defines a tip of one of the wing or discourager.

13. A rim seal between a rotor and a stator of a turbine engine comprising:

a wing extending from the rotor;

a discourager extending from the stator; and a labyrinth fluid path formed between the wing and the discourager;

wherein at least a portion of one of the wing and the discourager is formed from a porous material.

14. The rim seal of claim 13 wherein the porous material has at least one of a structured porosity or random porosity.

15. The rim seal of claim 13 wherein the porous material is in a portion of both the wing and the discourager.

16. The rim seal of claim 13 wherein the porous material is located in a middle section of one of the wing or discourager.

17. The rim seal of claim 13 wherein the porous material is located in a terminal end of one of the wing or discourager.

18. The rim seal of claim 13 wherein the entire wing or discourager is porous material.

19. The rim seal of claim 13 wherein the wing and discourager at least partially overlap in an axial direction and are spaced in a radial direction.

20. The rim seal of claim 19 wherein the radial spacing is greater than the radial tolerances between the wing and the discourager and the axial spacing is greater than the axial tolerances between the rotor and the stator.

21. The rim seal of claim 13 wherein the porous material is located in a radial extension.

22. The rim seal of claim 21 wherein the radial extension extends into a cavity.

23. The rim seal of claim 22 wherein the radial extent is less than radial tolerances between the rotor and the stator.

24. A rim seal for turbine engine comprising a wing extending from a rotor and a discourager extending from a stator with at least a portion of one of the wing and discourager formed from a porous material.

25. The rim seal of claim 24 wherein the porous material has at least one of a structured porosity or random porosity.

26. The rim seal of claim 25 wherein the porous material is in a portion of both the wing and discourager.

27. The rim seal of claim 26 wherein the wing and discourager at least partially overlap in an axial direction and are spaced in a radial direction.

28. The rim seal of claim 27 wherein the radial spacing is greater than the radial tolerances between the wing and the discourager and the axial spacing is greater than the axial tolerances between the rotor and the stator.

* * * * *